US011094448B2

(12) United States Patent
Lim et al.

(10) Patent No.: US 11,094,448 B2
(45) Date of Patent: Aug. 17, 2021

(54) INDUCTOR AND INDUCTOR MODULE HAVING THE SAME

(71) Applicant: SAMSUNG ELECTRO-MECHANICS CO., LTD., Suwon-si (KR)

(72) Inventors: Sung Jun Lim, Suwon-si (KR); Yeong Min Jeong, Suwon-si (KR); Han Kim, Suwon-si (KR); Kyung Ho Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 255 days.

(21) Appl. No.: 16/155,165

(22) Filed: Oct. 9, 2018

(65) Prior Publication Data

US 2019/0348210 A1 Nov. 14, 2019

(30) Foreign Application Priority Data

May 14, 2018 (KR) ..... 10-2018-0054719

(51) Int. Cl.

| | |
|---|---|
| ***H01F 5/00*** | (2006.01) |
| ***H01F 27/28*** | (2006.01) |
| ***H01F 27/32*** | (2006.01) |
| ***H01F 27/02*** | (2006.01) |
| ***H01F 27/29*** | (2006.01) |

(52) U.S. Cl.

CPC ..... *H01F 27/2804* (2013.01); *H01F 27/022* (2013.01); *H01F 27/29* (2013.01); *H01F 27/323* (2013.01); *H01F 2027/2809* (2013.01)

(58) Field of Classification Search

USPC ..... 336/200, 223, 232

See application file for complete search history.

(56) References Cited

U.S. PATENT DOCUMENTS

| | | | | |
|---|---|---|---|---|
| 6,181,232 | B1 * | 1/2001 | Kitamura | H01F 17/04 336/200 |
| 6,218,925 | B1 * | 4/2001 | Iwao | H01F 17/0013 336/200 |
| 2006/0158825 | A1 * | 7/2006 | Hidaka | H01G 4/012 361/303 |
| 2008/0157913 | A1 | 7/2008 | Kim | |
| 2010/0328007 | A1 | 12/2010 | Witzani et al. | |

(Continued)

FOREIGN PATENT DOCUMENTS

| | | | |
|---|---|---|---|
| JP | 5382123 | B2 | 1/2014 |
| KR | 10-0869741 | B1 | 11/2008 |

(Continued)

*Primary Examiner* — Ronald Hinson

(74) *Attorney, Agent, or Firm* — Morgan, Lewis & Bockius LLP

(57) ABSTRACT

An inductor includes: a body in which a plurality of insulating layers on which a plurality of coil patterns are arranged are stacked; and first and second external electrodes disposed on an external surface of the body, wherein the plurality of coil patterns are connected to each other through a coil connection portion and form a coil having both ends connected to the first and second external electrodes through a coil withdrawal portion, and wherein the coil connection portion is configured as a material having a higher thermal expansion coefficient than that of the insulating layers.

13 Claims, 4 Drawing Sheets

(56) References Cited

U.S. PATENT DOCUMENTS

| | | | | |
|---|---|---|---|---|
| 2012/0119867 | A1 | 5/2012 | Odahara et al. | |
| 2013/0187744 | A1* | 7/2013 | Seko | H01F 17/0013 336/200 |
| 2016/0225513 | A1 | 8/2016 | Park et al. | |
| 2017/0256353 | A1* | 9/2017 | Park | H01F 17/04 |
| 2018/0166199 | A1* | 6/2018 | Hachiya | H01F 27/2804 |
| 2019/0244741 | A1* | 8/2019 | Murakami | H01F 17/0013 |

FOREIGN PATENT DOCUMENTS

| | | | |
|---|---|---|---|
| KR | 10-1544025 | B1 | 8/2015 |
| KR | 10-1652848 | B1 | 8/2016 |

* cited by examiner

INDUCTOR AND INDUCTOR MODULE HAVING THE SAME

CROSS-REFERENCE TO RELATED APPLICATION(S)

This application claims the benefit of priority to Korean Patent Application No. 10-2018-0054719 filed on May 14, 2018 in the Korean Intellectual Property Office, the disclosure of which is incorporated herein by reference in its entirety.

TECHNICAL FIELD

The present disclosure relates to an inductor and an inductor module having the same.

BACKGROUND

Recently, smartphones have been implemented with the ability to use many frequency bands due to the application of multiband long term evolution (LTE). As a result, high frequency inductors are mainly used as impedance matching circuits in signal RF transmission and reception systems. High frequency inductors are required to be smaller in size and higher in capacity. Additionally, high frequency inductors are required to have high self-resonant frequency (SRF) in a high frequency band and low resistivity such that they may be used at a high frequency of 100 MHz or more. Also, high frequency inductors are required to have high Q characteristics so as to reduce the loss at the used frequency.

In order to have such a high Q characteristic, the characteristics of a material constituting an inductor body have the greatest influence. However, even if the same material is used, since a Q value may vary according to the shape of an inductor coil, there is a need for a method of optimizing the shape of the inductor coil to have higher Q characteristics.

SUMMARY

An aspect of the present disclosure may provide an inductor having high Q characteristics and an inductor module having the same.

According to an aspect of the present disclosure, an inductor may include a body including a plurality of insulating layers and a plurality of coil patterns alternatively stacked therein; and first and second external electrodes disposed on an external surface of the body, in which the plurality of coil patterns are connected to each other through a coil connection portion and form a coil having both ends electrically connected to the first and second external electrodes, respectively, through a coil withdrawal portion, and the coil connection portion has a material having a thermal expansion coefficient higher than a thermal expansion coefficient of the insulating layers.

According to another aspect of the present disclosure, an inductor module may include an inductor including a plurality of insulating layers and a plurality of coil patterns alternatively stacked therein, and further include a coil connection portion penetrating through the plurality of insulating layers and connecting the plurality of coil patterns to each other; a substrate on which the inductor is mounted; and a sealing material configured to seal the inductor, in which the coil connection portion has a material having a thermal expansion coefficient higher than a thermal expansion coefficient of the insulation layers.

According to an aspect of the present disclosure, an inductor may include a body including a plurality of insulating layers and a plurality of coil patterns alternatively stacked therein; and first and second external electrodes disposed on an external surface of the body, in which the plurality of coil patterns are connected to each other through a coil connection portion and form a coil having both ends electrically connected to the first and second external electrodes, respectively, through a coil withdrawal portion, and the coil connection portion has a material having a thermal expansion coefficient different than a thermal expansion coefficient of the insulating layers.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
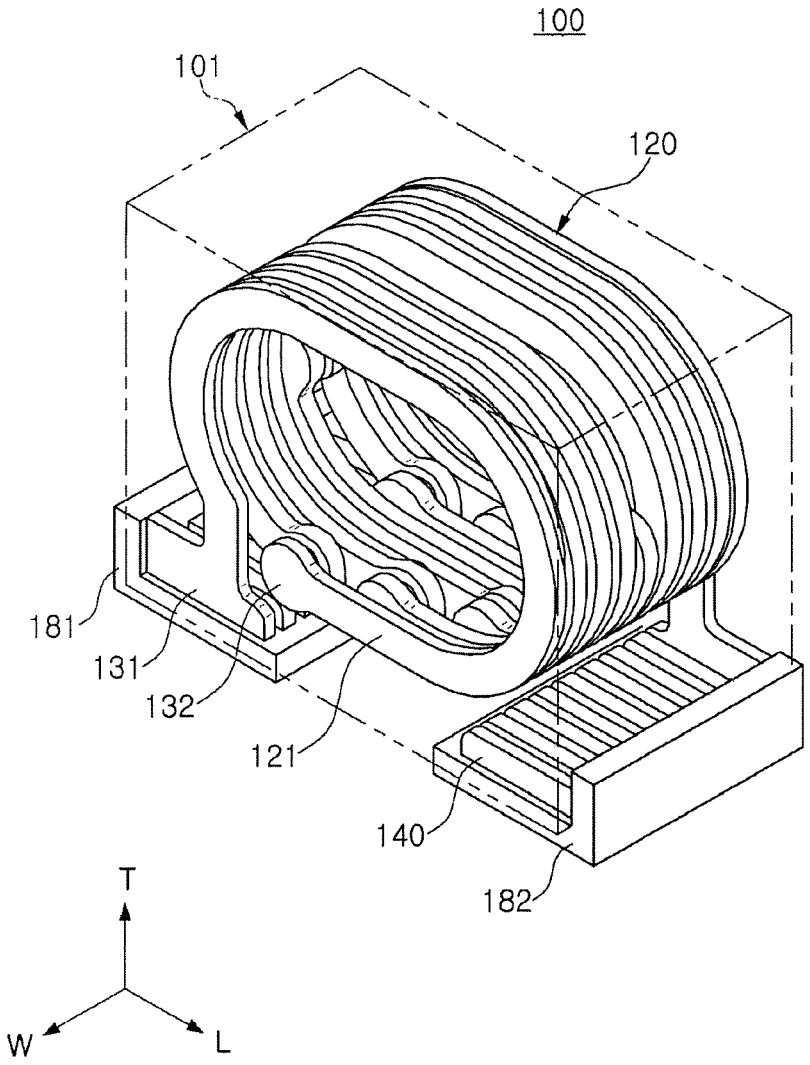
FIG. 1 is a projected perspective view schematically illustrating an inductor according to an exemplary embodiment in the present disclosure.

Hereinafter, exemplary embodiments in the present disclosure will now be described in detail with reference to the accompanying drawings.

Hereinafter, W, L, and T in the drawings may be defined as a first direction, a second direction, and a third direction, respectively.

Figure 2:
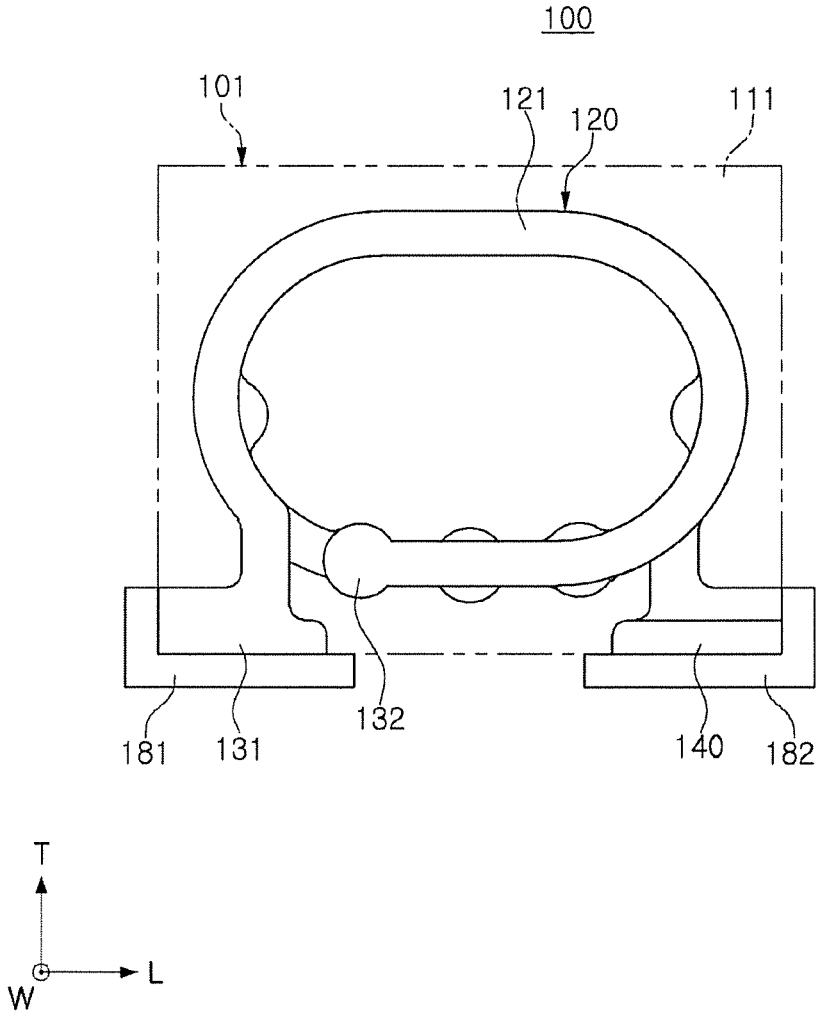
FIG. 2 is a front view of the inductor shown in FIG. 1.
Figure 3:
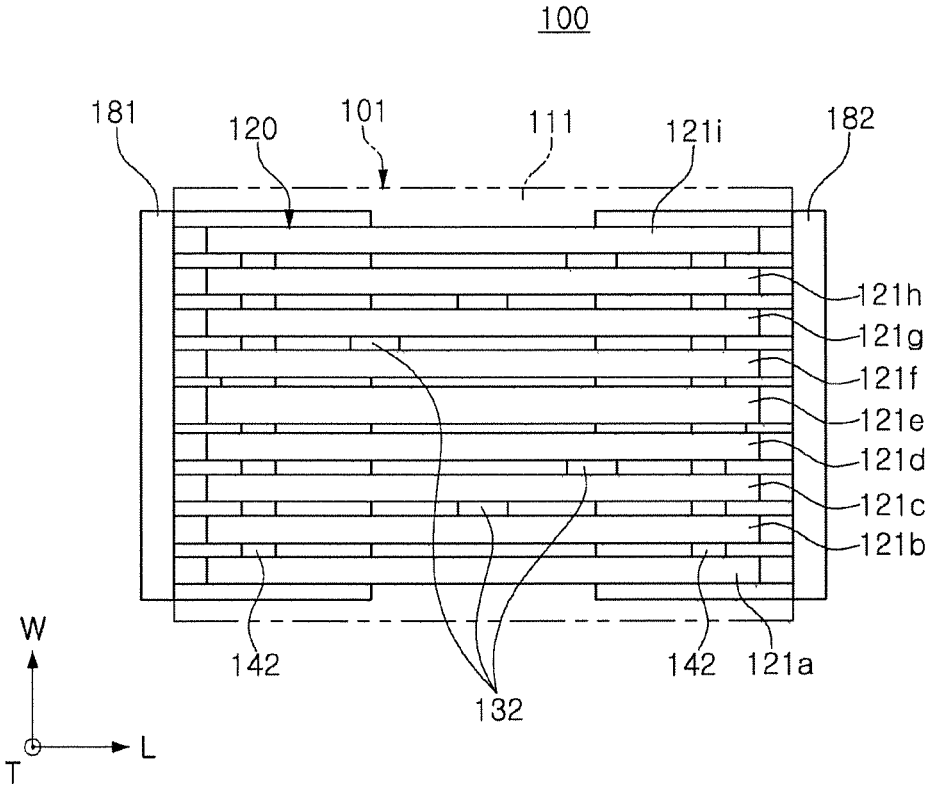
FIG. 3 is a plan view of the inductor shown in FIG. 1.
Figure 4:
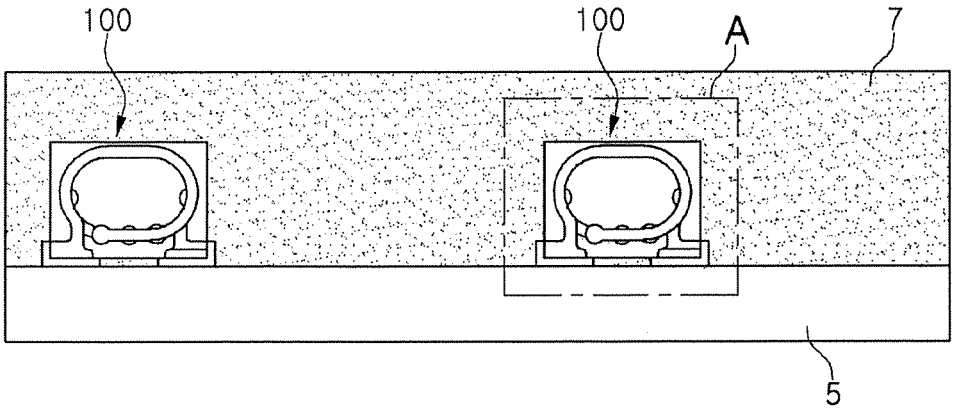
FIG. 4 is a cross-sectional view of an inductor module including the inductor of FIG. 1.
Figure 5:
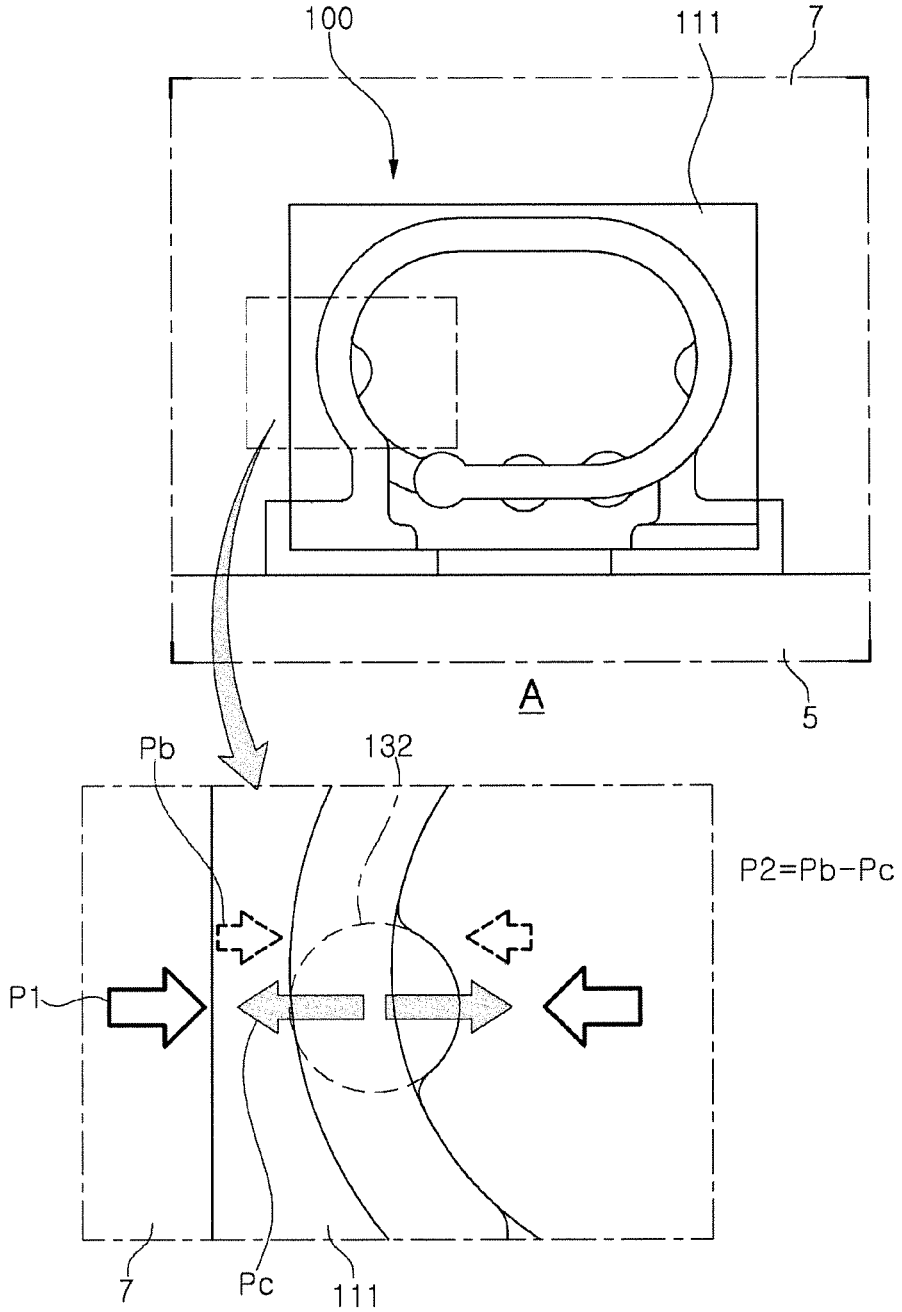
FIG. 5 is an enlarged cross-sectional view of a portion A of FIG. 4.

FIG. 1 is a projected perspective view schematically illustrating an inductor 100 according to an exemplary embodiment in the present disclosure. FIG. 2 is a front view of the inductor 100 shown in FIG. 1. FIG. 3 is a plan view of the inductor 100 shown in FIG. 1. Also, FIG. 4 is a cross-sectional view of an inductor module including the inductor 100 of FIG. 1. FIG. 5 is an enlarged cross-sectional view of a portion A of FIG. 4.

A structure of the inductor 100 according to an exemplary embodiment in the present disclosure will be described with reference to FIGS. 1 through 5.

A body 101 of the inductor 100 may be formed by stacking a plurality of insulating layers 111 in a first direction horizontal to a mounting surface.

The insulating layer 111 may be a magnetic layer or a dielectric layer.

When the insulating layer 111 is the dielectric layer, the insulating layer 111 may include $BaTiO_3$ (barium titanate) based ceramic powder or the like. In this case, the $BaTiO_3$ based ceramic powder may be, for example, $(Ba_{1-x}Ca_x)TiO_3$, $Ba(Ti_{1-y}Ca_y)O_3$, $(Ba_{1-x}Ca_x)(Ti_{1-y}Zr_y)O_3$ or $Ba(Ti_{1-y}Zr_y)O_3$ in which Ca (calcium), Zr (zirconium), etc. are partially employed in $BaTiO_3$, but the present disclosure is not limited thereto.

When the insulating layer 111 is the magnetic layer, the insulating layer 111 may select a suitable material from materials that may be used as the body 101 of the inductor 100, for example, resin, ceramic, ferrite, etc. In the present embodiment, the magnetic layer may use a photosensitive insulating material, thereby enabling the implementation of a fine pattern through a photolithography process. That is, by forming the magnetic layer with the photosensitive insulating material, a coil pattern 121, a coil withdrawal portion 131 and a coil connection portion 132 may be finely formed, thereby contributing to the miniaturization and function improvement of the inductor 100. To this end, the magnetic layer may include, for example, a photosensitive organic material or a photosensitive resin. In addition, the magnetic layer may further include an inorganic component such as $SiO_2/Al_2O_3/BaSO_4$/Talc, etc. as a filler component.

Also, the insulating layer 111 according to the present embodiment has a material having a lower thermal expansion coefficient than a coil connection portion 132 which will be described later. For example, the insulating layer 111 may adjust the thermal expansion coefficient by adjusting an amount of powder or filler.

The insulating layer 111 according to the present embodiment may be formed of a ceramic or resin material. It is also possible to use resin (for example, epoxy) containing filler (for example, silica filler). However, the present disclosure is not limited thereto.

First and second external electrodes 181 and 182 may be disposed outside the body 101.

For example, the first and second external electrodes 181 and 182 may be disposed on the mounting surface of the body 101. The mounting surface means a surface facing a printed circuit board (PCB) when the inductor 100 is mounted on the PCB.

The external electrodes 181 and 182 serve to electrically connect the inductor 100 to the PCB when the inductor 100 is mounted on the PCB. The external electrodes 181 and 182 are spaced apart from each other on an edge of the mounting surface of the body 101.

The external electrodes 181 and 182 may include, for example, a conductive resin layer and a conductive layer formed on the conductive resin layer, but are not limited thereto. The conductive resin layer may include one or more conductive metals selected from the group consisting of copper (Cu), nickel (Ni), and silver (Ag) and a thermosetting resin. The conductive layer may include one or more materials selected from the group consisting of nickel (Ni), copper (Cu), and tin (Sn). For example, a nickel (Ni) layer and a tin (Sn) layer may be sequentially formed.

The coil pattern 121 may be formed on the insulating layer 111.

The coil pattern 121 may be electrically connected to the adjacent coil pattern 121 by the coil connection portion 132. That is, the helical coil patterns 121 are connected by the coil connection portion 132 to form a coil 120. The coil connection portion 132 may have a line width larger than that of the coil pattern 121 to improve the connectivity between the coil patterns 121 and may include a conductive via penetrating through the insulating layer 111.

Both ends of the coil 120 are connected to the first and second external electrodes 181 and 182 by the coil withdrawal portion 131, respectively. The coil withdrawal portion 131 may be exposed at both ends of the body 101 in a longitudinal direction and may be exposed to a bottom surface that is a substrate mounting surface. Accordingly, the coil withdrawal portion 131 may have an L-shaped cross section in a length-thickness direction of the body 101.

Referring to FIGS. 2 and 3, a dummy electrode 140 may be formed at a position corresponding to the external electrodes 181 and 182 in the insulating layer 111. The dummy electrode 140 may serve to improve the adhesion between the external electrodes 181 and 182 and the body 101 or may serve as a bridge when the external electrodes 181 and 182 are formed by plating.

The dummy electrode 140 and the coil withdrawal portion 131 may also be connected to each other by a via electrode 142.

As materials of the coil pattern 121, the coil withdrawal portion 131 and the coil connection portion 132, conductive materials such as copper, aluminum (Al), silver (Ag), tin (Sn), gold (Au), nickel (Ni), lead (Pb) having excellent conductivity, or alloys thereof. The coil pattern 121, the coil withdrawal portion 131, and the coil connection portion 132 may be formed by a plating method or a printing method, but are not limited thereto.

The inductor 100 according to an exemplary embodiment in the present disclosure is manufactured by forming the coil pattern 121, the coil withdrawal portion 131 or the coil connection portion 132 on the insulating layer 111 and then stacking the insulating layer 111 on the mounting surface in the first direction horizontal to the mounting surface as shown in FIG. 2, and thus the inductor 100 may be easily manufactured. Also, since the coil pattern 121 is disposed vertically to the mounting surface, the influence exerted on a magnetic flux by the mounting substrate may be minimized.

Referring to FIGS. 2 and 3, the coil 120 of the inductor 100 according to an exemplary embodiment in the present disclosure forms a coil track having one or more coil turn numbers by overlapping the coil patterns 121 when projected in the first direction.

Specifically, the first external electrode 181 and the first coil pattern 121*a* are connected by the coil withdrawal portion 131, and then first through ninth coil patterns 121*a* through 121*i* are sequentially connected by the coil connection portion 132. Finally, the ninth coil pattern 121*i* is connected to the second external electrode 182 by the coil withdrawal portion 131 to form the coil 120.

In the inductor 100 according to an exemplary embodiment in the present disclosure configured as above, the thermal expansion coefficient of a material constituting the coil connection portion 132 is configured to be larger than the thermal expansion coefficient of a material constituting the insulating layer 111.

For example, the coil connection portion 132 may have a material having a thermal expansion coefficient in the range of 16 to 18 ppm/° C., and the insulating layer 111 may have a material having a thermal expansion coefficient in the range of 4 to 15 ppm/° C.

Also, the thermal expansion coefficient of the coil connection portion 132 and the thermal expansion coefficient of the insulating layer 111 may have a difference of 1 ppm/° C. or more.

This will be described in more detail as follows.

The coil pattern 121 disposed in the insulating layer 111 has an asymmetric structure as a whole since the coil withdrawal portion 131 is disposed in a diagonal direction in the inductor 100 according to the present embodiment. Therefore, when pressure is applied from the outside, the coil connection portion 132 having a relatively low rigidity may be easily damaged.

As shown in FIG. 4, when the inductor 100 is mounted on a substrate 5 and then sealed with a sealing material 7 such as EMC in order to manufacture the inductor module, a contractive force generated when the sealing material 7 is cured or in a reflow process performed when the inductor module is mounted on a mother substrate, a large compressive stress (or a shear stress) acts on the inductor 100.

Also, due to a difference in the thermal expansion coefficient between the insulating layer 111 and the coil connection portion 132, force is applied to the coil connection portion 132 inside the inductor 100.

Thus, referring to FIG. 5, a force P received by the coil connection portion 132 is determined by a contractive force P1 of the sealing material 7 acting on the inductor 100 and a force P2 generated due to the difference in the thermal expansion coefficient between the coil connection portion 132 and the insulating layer 111.

Also, the force P2 generated due to the difference in the thermal expansion coefficient between the coil connection portion 132 and the insulating layer 111 is defined by a force $P_b$ applied to the coil connection portion 132 while the insulating layer 111 thermally expands and a force $P_c$ applied to the insulating layer 111 while the coil connection portion 132 thermally expands.

Here, since $P_b$ and $P_c$ act in opposite directions to each other, P2 is substantially proportional to a difference $(P_b-P_c)$ between $P_b$ and $P_c$.

When the thermal expansion coefficient of the insulating layer 111 is larger than the thermal expansion coefficient of the coil connection portion 132, since $P_b$ becomes larger than $P_c$, P2 becomes a positive number, and thus the force P applied to the coil connection portion 132 is a sum of P1 and P2.

Meanwhile, when the thermal expansion coefficient of the coil connection portion 132 is larger than the thermal expansion coefficient of the insulating layer 111, since $P_c$ becomes larger than $P_b$, P2 becomes a negative number, and thus the force P applied to the coil connection portion 132 is a difference of P1 and P2.

Therefore, when the thermal expansion coefficient of the coil connection portion 132 is larger than the thermal expansion coefficient of the insulating layer 111, since P2 acts in the opposite direction to P1, the influence of P1 may be minimized, thereby preventing the coil connection portion 132 from being damaged due to the contractive force of the sealing material 7 or the difference in the thermal expansion coefficient.

As described above, in the inductor 100 according to the present embodiment, the thermal expansion coefficient of the material constituting the coil connection portion 132 is configured to be larger than the thermal expansion coefficient of the material constituting the insulating layer 111.

In order to confirm the effect of the inductor 100 according to the present embodiment, the equivalent stress of the inductor 100 is measured in various situations.

As a result, in the case of the inductor 100 not mounted on the substrate 5 and not sealed with the sealing material 7, an equivalent stress of 16.96 MPa is measured in the coil connection portion 132.

When the inductor 100 having the thermal expansion coefficient of the coil connection portion 132 smaller than the thermal expansion coefficient of the insulating layer 111 is mounted on the substrate 5 and sealed with the sealing material 7 as shown in FIG. 4, an equivalent stress of 152.9 MPa is measured at the same position.

Meanwhile, when the inductor 100 having the thermal expansion coefficient of the coil connection portion 132 larger than the thermal expansion coefficient of the insulating layer 111 is mounted on the substrate 5 and sealed with the sealing material 7 as shown in FIG. 4, an equivalent stress of 118.7 MPa is measured at the same position.

Therefore, it is confirmed that the stress applied to the coil connection portion 132 is reduced to a level of 23% by adjusting the thermal expansion coefficient of the coil connection portion 132 and the thermal expansion coefficient of the insulating layer 111.

As described above, even if an inductor according to the present embodiment is sealed inside a sealing material, the inductor may prevent a coil connection portion from being damaged due to the contractive force of the sealing material and the thermal expansion of an insulating layer, thereby preventing the inductor from being damaged during an inductor mounting process.

As set forth above, according to the exemplary embodiment in the present disclosure, even if an inductor according to the present embodiment is sealed inside a sealing material, the inductor may prevent a coil connection portion from being damaged due to the contractive force of the sealing material or the thermal expansion of an insulating layer, thereby preventing the inductor from being damaged during an inductor mounting process.

While exemplary embodiments have been shown and described above, it will be apparent to those skilled in the art that modifications and variations could be made without departing from the scope in the present invention as defined by the appended claims.

What is claimed is:

1. An inductor comprising:

a body including a plurality of insulating layers and a plurality of coil patterns alternatively stacked therein; and first and second external electrodes disposed on an external surface of the body in a first direction, wherein the plurality of coil patterns are connected to each other through a coil connection portion and form a coil having both ends connected to the first and second external electrodes, respectively, through a coil withdrawal portion, wherein the coil connection portion has a material having a thermal expansion coefficient higher than a thermal expansion coefficient of the plurality of insulating layers, wherein the plurality of insulating layers include a magnetic layer and an inorganic filler component, and wherein the body further includes a dummy electrode spaced apart from the plurality of coil patterns and connected to the first or second external electrode, and a length of the dummy electrode in the first direction is smaller than a length of the coil withdrawal portion in the first direction.

2. The inductor of claim 1, wherein the plurality of insulating layers include a resin material containing a ceramic or a silica filler.

3. The inductor of claim 1, wherein the coil connection portion has any one material selected from copper (Cu), aluminum (Al), silver (Ag), tin (Sn), gold (Au), nickel (Ni), lead (Pb), or an alloy thereof.

4. The inductor of claim 1, wherein the thermal expansion coefficient of the plurality of insulating layers is within a range of 4 to 15 ppm/° C., and wherein the thermal expansion coefficient of the coil connection portion is within a range of 16 to 18 ppm/° C.

5. The inductor of claim 1, wherein the thermal expansion coefficient of the coil connection portion and the thermal expansion coefficient of the plurality of insulation layers have a difference of 1 ppm/° C. or more.

6. The inductor of claim 1, wherein the inorganic filler component includes at least one of $SiO_2$, $Al_2O_3$, $BaSO_4$, or Talc.

7. An inductor module comprising:

an inductor including:

a plurality of insulating layers and a plurality of coil patterns alternatively stacked therein;

including a coil connection portion penetrating through the plurality of insulating layers and connecting the plurality of coil patterns to each other; and first and second external electrodes disposed on an external surface of the inductor in a first direction;

a substrate on which the inductor is mounted; and a sealing material configured to seal the inductor, wherein the coil connection portion has a material having a thermal expansion coefficient higher than a thermal expansion coefficient of the plurality of insulation layers, wherein the plurality of insulating layers include a magnetic layer and an inorganic filler component, wherein the plurality of coil patterns form a coil having both ends connected to the first and second external electrodes, respectively, through a coil withdrawal portion, and wherein the inductor further includes a dummy electrode spaced apart from the plurality of coil patterns and connected to the first or second external electrode, and a length of the dummy electrode in the first direction is smaller than a length of the coil withdrawal portion in the first direction.

8. The inductor module of claim 7, wherein the inductor is mounted vertically on the substrate, where a planar surface of each of the plurality of coil patterns is orthogonal to a mounting surface of the inductor.

9. The inductor module of claim 7, wherein the plurality of insulating layers include a resin material containing a ceramic or a silica filler.

10. The inductor module of claim 7, wherein the coil connection portion has any one material selected from copper (Cu), aluminum (Al), silver (Ag), tin (Sn), gold (Au), nickel (Ni), lead (Pb), or an alloy thereof.

11. The inductor module of claim 7, wherein the thermal expansion coefficient of the plurality of insulating layers is within a range of 4 to 15 ppm/cc, and wherein the thermal expansion coefficient of the coil connection portion is within a range of 16 to 18 ppm/cc.

12. The inductor module of claim 7, wherein the thermal expansion coefficient of the coil connection portion and the thermal expansion coefficient of the plurality of insulation layers have a difference of 1 ppm/cc or more.

13. The inductor module of claim 7, wherein the inorganic filler component includes at least one of $SiO_2$, $Al_2O_3$, $BaSO_4$, or Talc.

* * * * *